US009828804B2

(12) United States Patent
Pearce et al.

(10) Patent No.: US 9,828,804 B2
(45) Date of Patent: Nov. 28, 2017

(54) MULTI-ANGLE ROTARY STEERABLE DRILLING

(71) Applicant: Schlumberger Technology Corporation, Sugar Land, TX (US)

(72) Inventors: Michael Pearce, Cheltenham (GB); Junichi Sugiura, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 914 days.

(21) Appl. No.: 14/062,963

(22) Filed: Oct. 25, 2013

(65) Prior Publication Data

US 2015/0114719 A1 Apr. 30, 2015

(51) Int. Cl.

| | |
|---|---|
| ***E21B 7/04*** | (2006.01) |
| ***E21B 17/16*** | (2006.01) |
| ***E21B 3/00*** | (2006.01) |
| ***E21B 7/06*** | (2006.01) |

(52) U.S. Cl.

CPC ..... *E21B 7/04* (2013.01); *E21B 3/00* (2013.01); *E21B 7/067* (2013.01); *E21B 17/16* (2013.01)

(58) Field of Classification Search

CPC ... E21B 17/16; E21B 3/00; E21B 7/04; E21B 7/06

See application file for complete search history.

(56) References Cited

U.S. PATENT DOCUMENTS

| | | | | |
|---|---|---|---|---|
| 5,265,682 | A | 11/1993 | Russell et al. | |
| 5,311,953 | A | 5/1994 | Walker | |
| 6,092,610 | A * | 7/2000 | Kosmala | E21B 4/20 175/27 |
| 6,216,802 | B1 * | 4/2001 | Sawyer | E21B 7/067 175/61 |
| 6,394,193 | B1 | 5/2002 | Askew | |
| 6,843,332 | B2 * | 1/2005 | Eppink | E21B 4/006 175/320 |
| 7,188,685 | B2 | 3/2007 | Downton et al. | |
| 8,522,897 | B2 | 9/2013 | Hall et al. | |
| 8,701,795 | B2 | 4/2014 | Menger et al. | |
| 2003/0121702 | A1 | 7/2003 | Downton et al. | |
| 2003/0127252 | A1 | 7/2003 | Downton et al. | |
| 2005/0000684 | A1 * | 1/2005 | Slack | B25B 5/065 166/77.1 |

(Continued)

FOREIGN PATENT DOCUMENTS

| | | |
|---|---|---|
| GB | 2426265 | 11/2006 |

OTHER PUBLICATIONS

International search report and written opinion for the equivalent PCT patent application No. PCT/US2014/059795 dated Jan. 23, 2015.

(Continued)

*Primary Examiner* — Robert E Fuller

*Assistant Examiner* — Christopher Sebesta

(57) ABSTRACT

Rotary steerable drilling apparatus and methods utilizing apparatus comprising a shaft, a multi-angle strike ring axially repositionable along the shaft, an articulated member coupled to the shaft, and a steering member carried by the articulated member. An actuator is operable to maintain an angular offset of the articulated member relative to the shaft by maintaining azimuthally-dependent contact between the multi-angle strike ring and the steering member.

20 Claims, 7 Drawing Sheets

(56) References Cited

U.S. PATENT DOCUMENTS

| | | | | |
|---|---|---|---|---|
| 2006/0263215 | A1 | 11/2006 | Sindt et al. | |
| 2009/0266532 | A1* | 10/2009 | Revheim | E21B 19/16 166/53 |
| 2010/0000794 | A1 | 1/2010 | Hall et al. | |
| 2010/0025115 | A1 | 2/2010 | Kotsonis et al. | |
| 2011/0284233 | A1 | 11/2011 | Wu et al. | |
| 2012/0199363 | A1 | 8/2012 | Hu | |
| 2012/0312600 | A1* | 12/2012 | Abbasi | F16D 3/16 175/320 |
| 2013/0000984 | A1 | 1/2013 | Menger et al. | |
| 2014/0209389 | A1 | 7/2014 | Sugiura et al. | |

OTHER PUBLICATIONS

Partial Search Report (164(1)) issued in corresponding European application EP 14856771.2 dated Oct. 17, 2016. 7 pages.
First Office Action and Search Report Issued in Chinese patent application 2014800565217 dated Dec. 30, 2016. 16 pages.
Supplementary Search Report (Art. 153(7) EPC) issued in European patent application 14856771.2 dated Jan. 18, 2017. 6 pages.
Examination Report (94(3) issued in European patent application 14856771.2 dated Mar. 20, 2017. 7 pages.
International Preliminary Report on Patentability issued in International patent application PCT/US2014/059795 dated May 6, 2016. 7 pages.
2nd Office Action and Search Report issued in Chinese patent application 201480056521.7 dated Sep. 11, 2017. 14 pages.

* cited by examiner

MULTI-ANGLE ROTARY STEERABLE DRILLING

BACKGROUND OF THE DISCLOSURE

In downhole drilling operations, a rotary steerable system (RSS) is utilized to drill a well with one or more horizontal and/or otherwise deviated sections. For example, an RSS may initially drill vertically and then kick off at an angle to drill a lateral portion of a well in a single run. The extent to which an RSS can turn or build angle to form a dogleg portion of the well may be limited by control and steerability issues, which can result in a less than optimal rate of penetration (ROP).

SUMMARY OF THE DISCLOSURE

The present disclosure introduces an apparatus comprising a shaft, a multi-angle strike ring axially repositionable along the shaft, and an articulated member coupled to the shaft. The apparatus may further comprise a steering member carried by the articulated member, and an actuator operable to maintain an angular offset of the articulated member relative to the shaft by maintaining azimuthally-dependent contact between the multi-angle strike ring and the steering member.

The present disclosure also introduces a method comprising operating an actuator to maintain a first angular offset of an articulated member, relative to a shaft coupled to the articulated member, by maintaining azimuthally-dependent contact between: a multi-angle strike ring positioned in a first axial position relative to the shaft; and a steering member carried by the articulated member. Such method may further comprise axially translating the multi-angle strike ring along the shaft from the first axial position to a second axial position, and operating the actuator to maintain a second angular offset of the articulated member relative to the shaft by maintaining azimuthally-dependent contact between the steering member and the multi-angle strike ring positioned in the second axial position. The second angular offset may be substantially different than the first angular offset.

The present disclosure also introduces a method comprising drilling a first portion of a borehole with a downhole tool by rotating a string of tubular members coupled to the downhole tool while operating an actuator of the downhole tool to maintain a first angular offset between axes of the downhole tool and a drill bit carried by the downhole tool. Such method may further comprise adjusting the first angular offset to a second angular offset by changing a pressure or flow rate of a drilling fluid flowing through the downhole tool from the string of tubular members, and drilling a second portion of the borehole with the downhole tool by rotating the string of tubular members while operating the actuator to maintain the second angular offset.

Additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
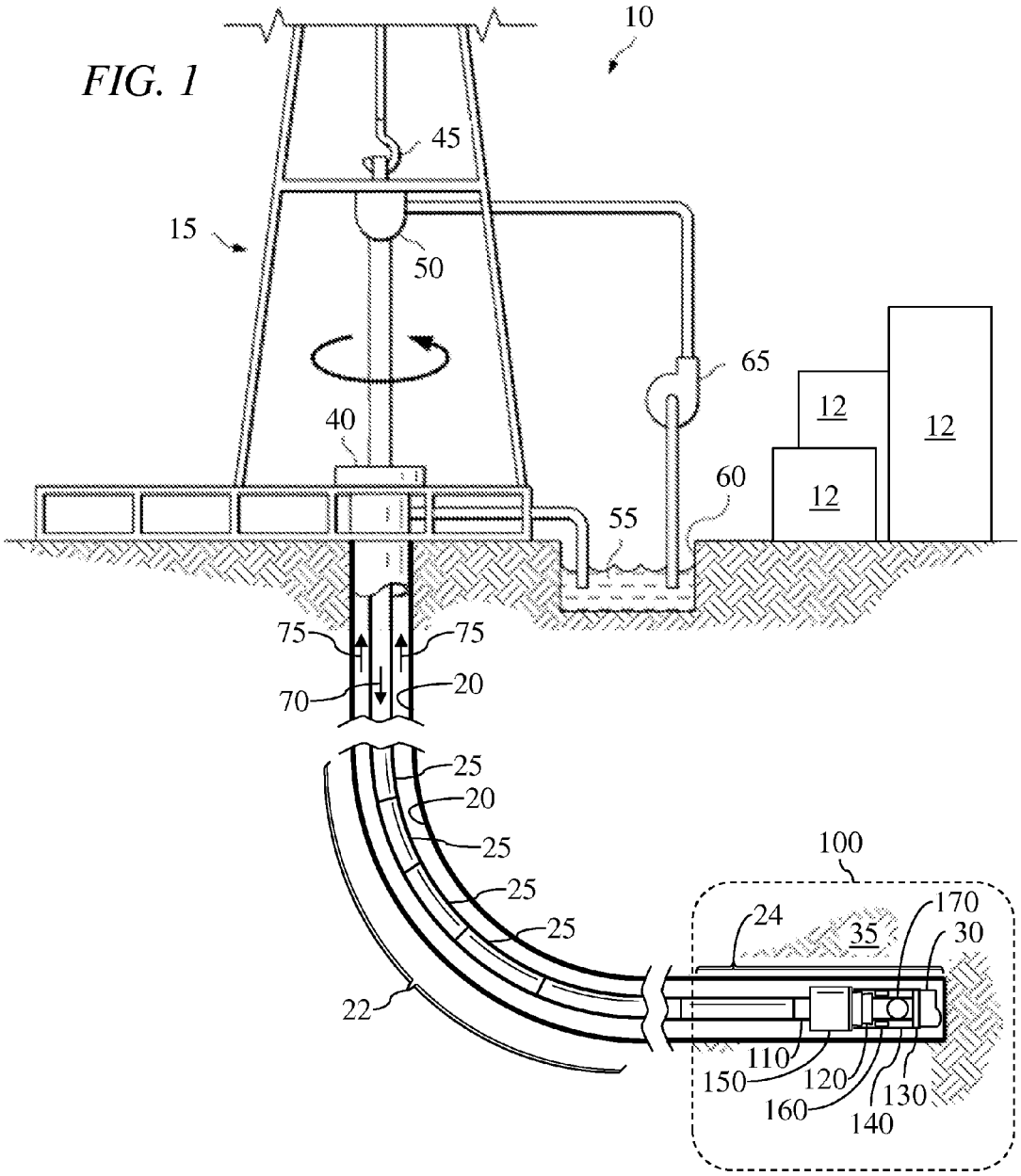
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a schematic view of at least a portion of apparatus according to one or more aspects of the present disclosure. Depicted components include a wellsite 10, a rig 15, and a downhole tool 100 suspended from the rig 15 in a borehole 20 via a drill string and/or other string of tubular members 25. The downhole tool 100 or a bottom hole assembly ("BHA") comprising the downhole tool 100 comprises or is coupled to a drill bit 30 at its lower end, which is operable to advance the downhole tool 100 into a formation 35 and form the borehole 20. The string of tubular members 25 may be rotated by a rotary table 40 that engages a kelly at the upper end of the string of tubular members 25. The string of tubular members 25 is suspended from a hook 45 attached to a traveling block (not shown) through the kelly and a rotary swivel 50 that permits rotation of the string of tubular members 25 relative to the hook 45.

The rig 15 is depicted as a land-based platform and derrick assembly utilized to form the borehole 20 by rotary drilling in a manner that is well known. However, a person having ordinary skill in the art will appreciate that one or more aspects of the present disclosure may also find application in other downhole implementations, and is not limited to land-based rigs. A person having ordinary skill in the art will also recognize that one or more aspects of the present disclosure may be applicable or readily adaptable for use with top drive systems in lieu of or addition to the above-described rotary table 40.

Drilling fluid (or "mud") 55 is stored in a pit 60 formed at the wellsite 10. A pump 65 delivers drilling fluid 55 to the interior of the string of tubular members 25 via a port in the rotary swivel 50, inducing the drilling fluid to flow downward through the string of tubular members 25, as indicated in FIG. 1 by directional arrow 70. The drilling fluid 55 exits the string of tubular members 25 via ports in the drill bit 30, and then circulates upward through the annulus defined between the outside of the string of tubular members 25 and the wall of the borehole 20, as indicated in FIG. 1 by direction arrows 75. In this manner, the drilling fluid 55 lubricates the drill bit 30 and carries formation cuttings up to the surface as it is returned to the pit 60 for recirculation.

The downhole tool 100 and/or BHA may be positioned near the drill bit 30, perhaps within the length of several drill collars and/or other tubular members 25 from the drill bit 30. The downhole tool 100 may comprise various components with various capabilities in addition to those providing steerability, such as measuring, processing, and storing information about the downhole tool 100, the BHA, and/or the subterranean formation 35. A telemetry device (not shown) is also provided for communicating with one or more components of surface equipment 12, such as may comprise acquisition and/or control equipment.

The downhole tool 100 may comprise a shaft 110, a multi-angle strike ring 120 repositionable along the shaft 110, an articulated member 130 coupled to the shaft 110, a steering member 140 carried by the articulated member 130, a strike ring actuator 150, and a plurality of steering member actuators 160. The articulated member 130 is articulated in the sense that it is coupled to the shaft 110 by a universal joint 170. The articulated member 130 also provides the mechanical and fluidic interface between the drill bit 30 and the universal joint 170 and/or shaft 110. The articulated member 130 may also be or comprise one or more flexible members.

The universal joint 170 permits an angular offset between the articulated member 130 and the shaft 110 while still imparting rotation of the shaft 110 to the articulated member 130 and passing drilling fluid 55 between internal passages of the shaft 110 and the articulated member 130. The steering member actuators 160 are collectively operable to maintain an angular offset of the articulated member 130 relative to the shaft 110 by maintaining azimuthally-dependent contact between the multi-angle strike ring 120 and the steering member 140. The drill bit 30 may be a component of or otherwise coupled to the articulated member 130, may be fixed cutter, roller cone, and/or other types of bits, and may comprise polycrystalline diamond compact (PDC) inserts, grit hotpressed inserts (GHI), tungsten carbide inserts (TCI), milled teeth (MT), and/or other types of inserts, and/or cutters.

Figure 2:
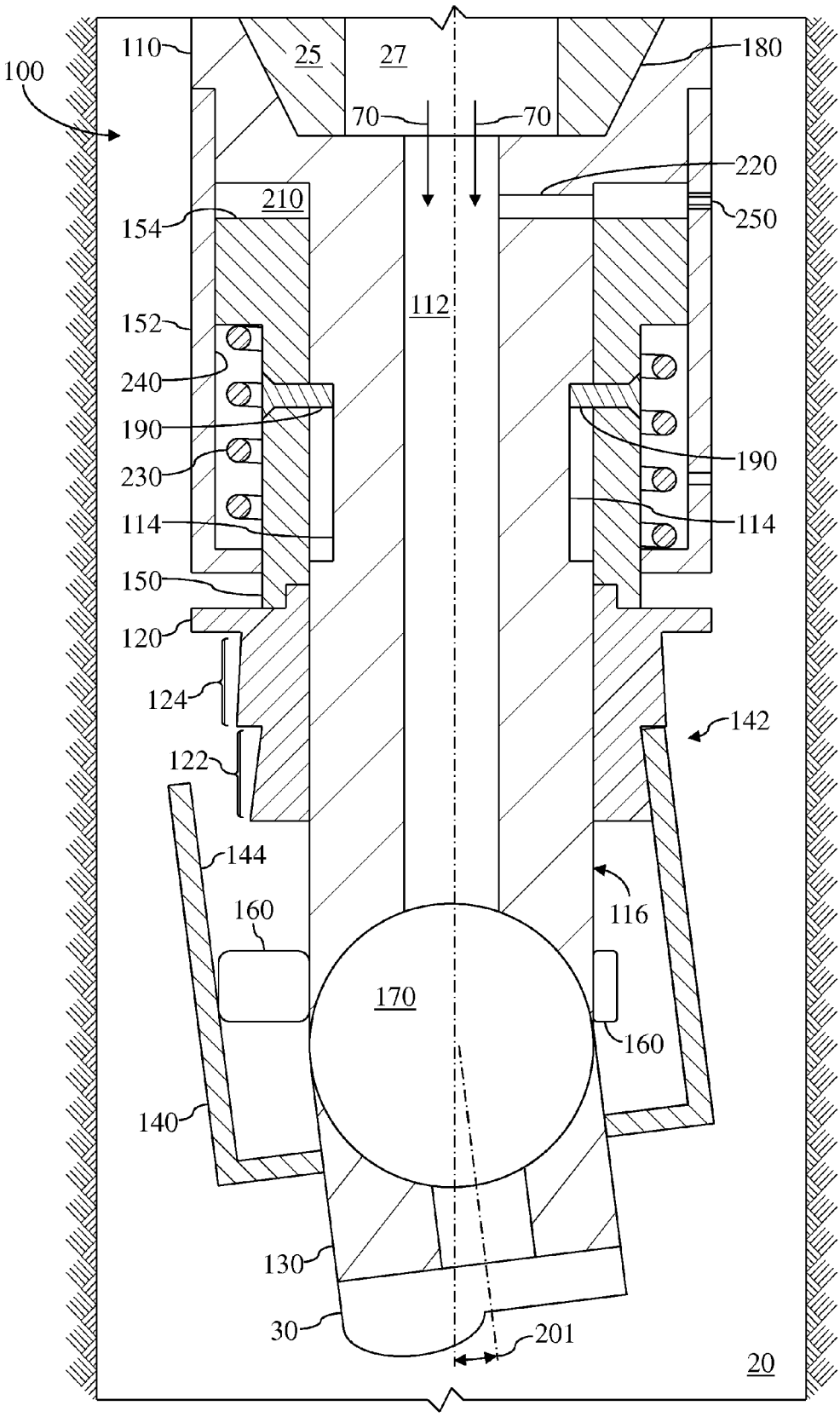
FIG. 2 is a schematic view of at least a portion of apparatus according to one or more aspects of the present disclosure.

FIG. 2 is a sectional view of at least a portion of the downhole tool 100 of FIG. 1. In operation, the steering member actuators 160 cooperate to urge the steering member 140 towards a first angular offset 201 relative to shaft 110. Consequently, an uphole end 142 of the steering member 140 contacts the multi-angle strike ring 120, whereby the multi-angle strike ring 120 constrains the steering member 140 from bending/tilting beyond the first angular offset 201. The resulting contact between the end 142 of the steering member 140 and the multi-angle strike ring 120 is maintained in an azimuthally-dependent manner by cooperative operation of the steering member actuators 160.

For example, referring to FIGS. 1 and 2 collectively, when the downhole tool 100 is being operated to drill or elongate a curved trajectory portion 22 of the borehole 20, maintaining the azimuthally-dependent contact between the multi-angle strike ring 120 and the steering member 140 comprises maintaining contact at a substantially constant azimuthal position relative to the borehole 20. The maintained contact (whether point contact, line contact, and/or surface contact) may vary azimuthally relative to the borehole 20, perhaps in proportion to rotation of the shaft 110 within the borehole 20.

In contrast, when the downhole tool 100 is being operated to drill or elongate another portion 24 of the borehole 20 along a substantially and/or effectively straight trajectory, maintaining the azimuthally-dependent contact between the multi-angle strike ring 120 and the steering member 140 comprises maintaining contact (whether point contact, line contact, and/or surface contact) that varies azimuthally relative to the borehole 20. An "effectively straight" trajectory may be that which is achieved via implementations in which the steering member actuators 160 are cooperatively operable to maintain an angular offset of the steering member 140 relative to the shaft 110 but are not operable to maintain straight or coaxial alignment of the steering member 140 relative to the shaft 110 (i.e., an angular offset of zero degrees). As such, the azimuthally rotating contact between the multi-angle strike ring 120 and the steering member 140 may result in the elongation of the borehole 20 along a helical trajectory around a substantially straight axis.

Best shown in FIG. 2, the downhole tool 100 and/or other portion of the BHA further comprises an interface 180 for coupling the shaft 110 with the string of tubular members 25. The interface 180 may be or comprise a threaded recess configured to receive a threaded end of an adjacent one of the tubular members 25, such as where the coupling between the shaft 110 and the adjacent tubular member 25 is an industry-standard pin-box connection. However, other means may be utilized within the scope of the present disclosure to couple the downhole tool 100 to the string of tubular members 25 and/or other borehole-conveyance means, including in implementations in which one or more intervening components are coupled between the shaft 110 and the adjacent conveyance member.

Figure 3:
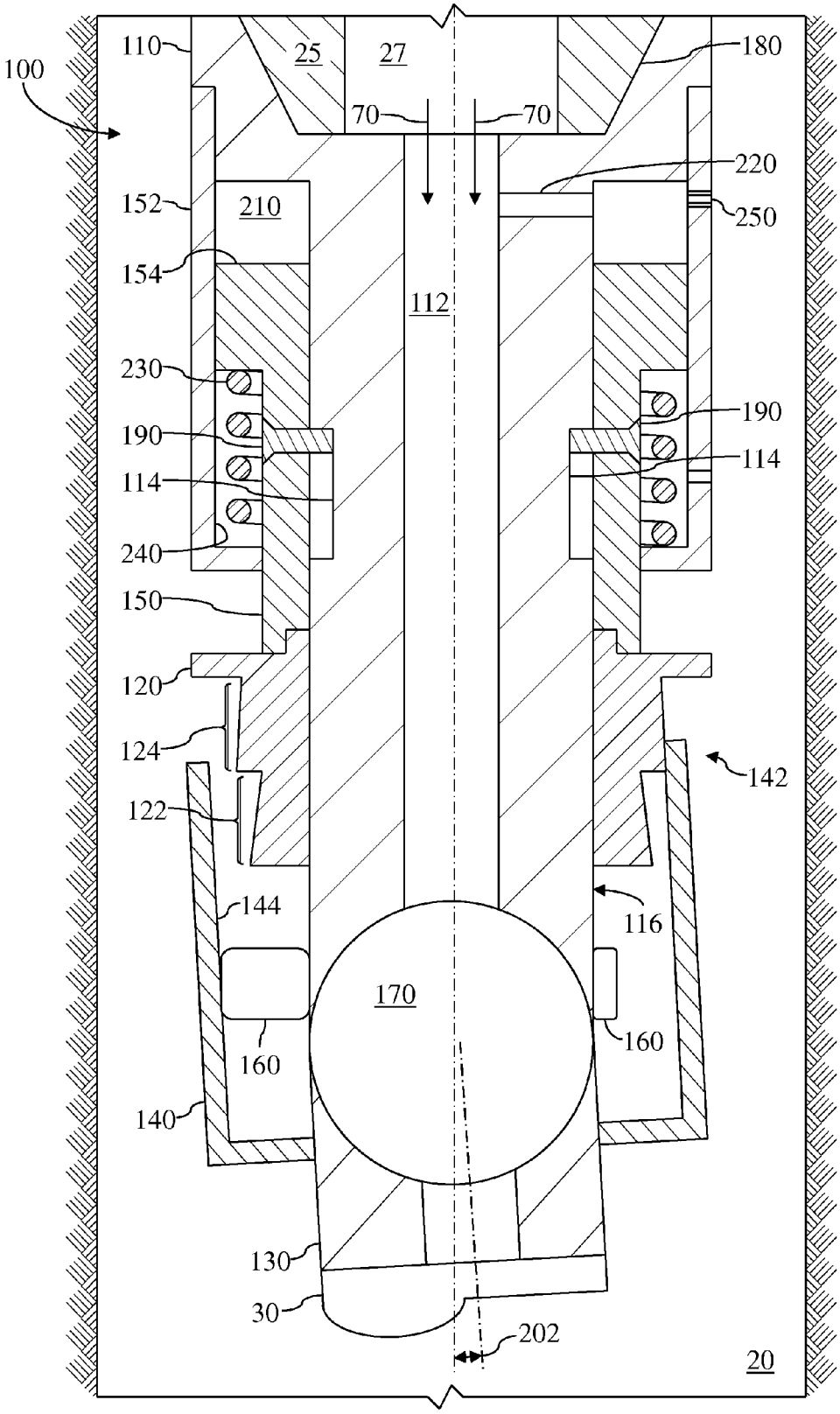
FIG. 3 is a schematic view of at least a portion of apparatus according to one or more aspects of the present disclosure.

The multi-angle strike ring 120 is axially repositionable along the shaft 110. For example, the multi-angle strike ring 120 may be axially repositionable between at least a first position on the shaft 110, such as the example position depicted in FIG. 2, and a second position on the shaft 120, such as the example position depicted in FIG. 3. The steering member actuators 160 and the multi-angle strike ring 120 may be collectively operable to maintain the first angular offset 201 of the articulated member 130 relative to the shaft 110 when the multi-angle strike ring 120 is in the first position (FIG. 2), and to maintain a second angular offset 202 of the articulated member 130 relative to the shaft 110 when the multi-angle strike ring 120 is in the second position (FIG. 3). The multi-angle strike ring 120 may comprise a first portion 122 contacting the end 142 of the steering member when the multi-angle strike ring 120 is in the first position (FIG. 2), and a second portion 124 contacting the end 142 of the steering member when the multi-angle strike ring 120 is in the second position (FIG. 3). The first and second portions 122 and 124 may each be substantially conical, perhaps having a cone angle substantially equal to the corresponding angular offset 201/202, such as may facilitate line contact between the steering member 140 and the multi-angle strike ring 120, instead of merely point contact.

The first angular offset 201 may be about twice the second angular offset 202. For example, the first angular offset 201 may be about one degree, and the second angular offset 202 may be about one-half of a degree. However, these are merely examples, and other values are also within the scope of the present disclosure. To adjust the angular offset between the articulated member 130 and the shaft 110, the multi-angle strike ring 120 may be axially repositionable along the shaft 110, perhaps in response to fluid pressure and/or flow rate changes within the string of tubular members 25. For example, referring to FIGS. 1-3 collectively, each tubular member 25 may have an internal passage 27 through which drilling fluid 55 may be pumped from the surface at the wellsite 10, as indicated in FIGS. 1-3 by arrows 70. The shaft 110 may have an internal passage 112 in fluid communication with the internal passage 27 of the string of tubular members 25, and may thus receive drilling fluid 55 from the string of tubular members 25.

Figure 4:
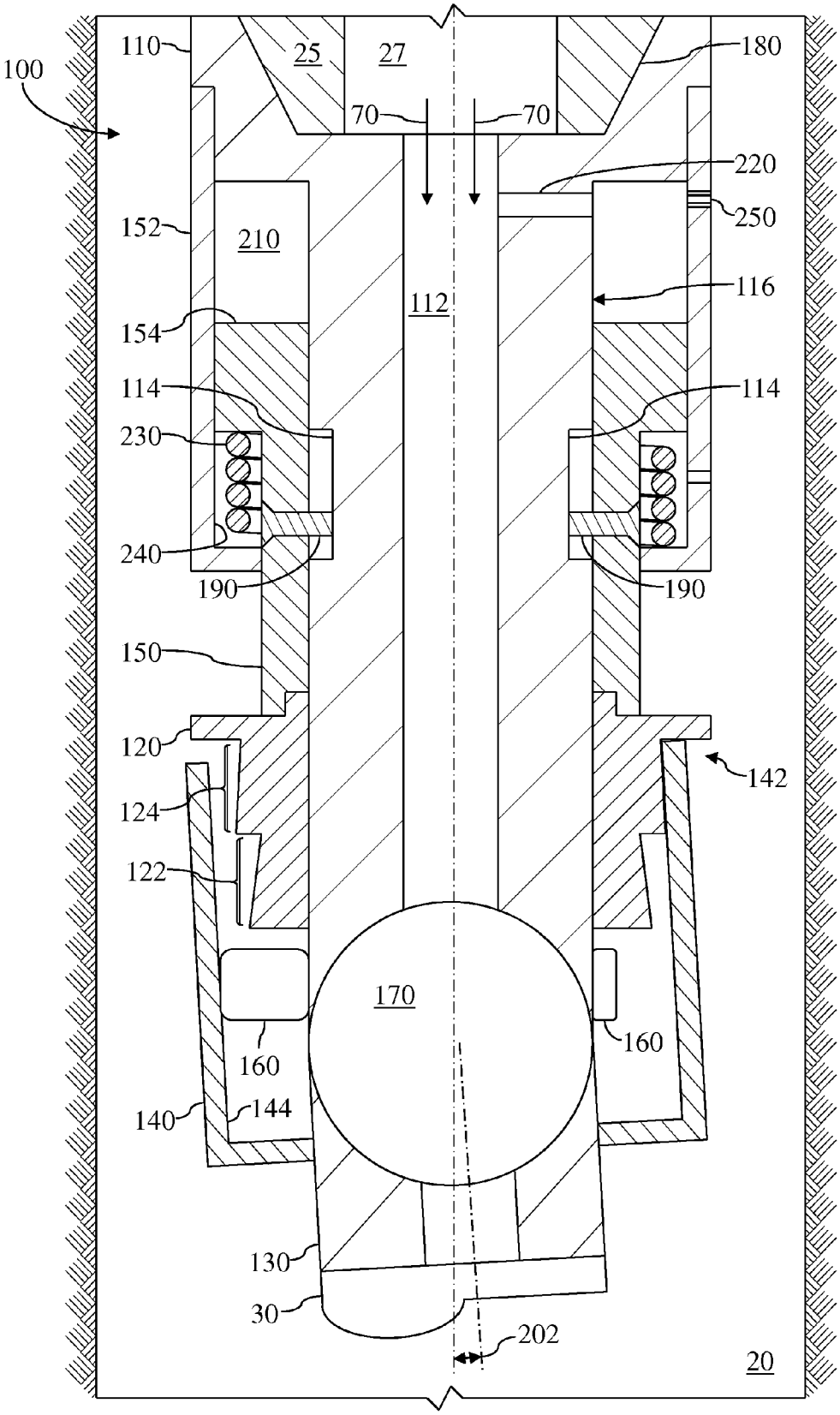
FIG. 4 is a schematic view of at least a portion of apparatus according to one or more aspects of the present disclosure.

The internal passage 112 of the shaft 110 may be in direct or indirect fluid communication with a chamber 210 of the downhole tool 110. As shown in FIGS. 2-4, the chamber 210 may be or comprise an annular volume defined by surfaces of the shaft 110, the strike ring actuator 150, and a retainer 152. The retainer 152 secures the strike ring actuator 150 to the shaft 110 in a manner permitting axial translation of the strike ring actuator 150 relative to the shaft 110. Fluid communication between the chamber 210 and the internal passage 112 of the shaft 110 may be via a port, channel, valve, and/or other means 220.

An increase in the pressure and/or flow rate of the drilling fluid flow in the internal passage 112 of the shaft 110 may act on an uphole surface 154 of the strike ring actuator 150 and/or otherwise urge the strike ring actuator 150 in a downhole direction. Such downhole motion of the strike ring actuator 150 may be resisted by a biasing member 230 positioned around the strike ring actuator 150 and/or within an additional chamber 240 of the downhole tool 100. The chamber 240 may be or comprise an annular volume defined by surfaces of the strike ring actuator 150 and the retainer 152.

The retainer 152 and/or another component of the downhole tool 100 may comprise a choke 250 establishing fluid communication between the chamber 210 and the borehole 20. The choke 250 may be or comprise a passive or active valve, orifice, and/or other means restricting fluid communication from the chamber 210 to the borehole 20 and/or otherwise controlling the pressure and/or flow rate within the chamber 210.

In operation, a surface control system (such as may form a portion of the surface equipment 12 shown in FIG. 1) may be utilized to communicate steering commands to electronics (not shown) in the downhole tool 100 and/or other portion of the BHA, either directly or via one or more measurement-while-drilling (MWD) and/or logging-while-drilling (LWD) tools included among or carried by the string of tubular members 25. The steering member actuators 160 individually or collectively tilt the steering member 140, the articulated member 130, and the drill bit 30 about the universal joint 170 with respect to the shaft 110 to maintain the angular offset 201/202 while all or part of the string of tubular members 25, the BHA, the downhole tool 100, and the bit 30 are rotated at a "drill string" RPM.

The universal joint 170 may transmit torque from the shaft 110 to the drill bit 30 through the articulated member 130 and/or other intervening components. However, the torque may be separately transmitted via other arrangements, such as may comprise flex connections, splined couplings, gearing arrangements, ball and socket joints, and/or recirculating ball arrangements, among others within the scope of the present disclosure. In this context, the universal joint 170 is depicted schematically in the figures of the present disclosure, because the details regarding the make-up and construction of the universal joint 170 are not limited within the scope of the present disclosure.

The angular offset 201/202 and, therefore, the direction of the drill bit 30 (sometimes referred to as the tool-face or tool-face orientation) may thus determine the direction in which the borehole 20 is being elongated. That is, the direction of the drill bit 30 leads the direction of the borehole 20. This may allow for a rotary steerable system formed by or comprising the downhole tool 100 to drill with little or no side force once a curve is established, and may minimize the amount of active control utilized to steer the borehole 20.

The steering member actuators 160 may comprise one or more pistons, inflatable members, and/or other means acting on an inner periphery 144 of the steering member 140. The steering member actuators 160 may be sequentially actuated as the steering member 140 rotates, so that the angular offset 201/202 is maintained with respect to the formation 35 being drilled, such as during elongation of the curved portion 22 of the borehole 20 shown in FIG. 1. Thereafter, the steering member actuators 160 may be actuated to elongate the borehole 20 along an effectively straight trajectory, such as the substantially straight portion 24 of the borehole 20 shown in FIG. 1.

When drilling along an effectively straight trajectory, the smallest angular offset attainable by adjusting the axial position of the multi-angle strike ring 120 may be utilized, such as to decrease the radius of the helical trajectory of the borehole 20. For example, the second portion 124 of the multi-angle strike ring 120, corresponding to the smaller angular offset 202 (FIG. 3), may be utilized when drilling an effectively straight portion of the borehole 20. However, the first portion 122 of the multi-angle strike ring 120, corresponding to the larger angular offset 201 (FIG. 2), may be utilized when drilling a curved portion of the borehole 20, such as to attain a tighter turn radius (or a greater build angle).

As described above, the multi-angle strike ring 120 may be axially repositioned along the shaft 110 by effecting a change in the pressure and/or flow rate of drilling fluid flowing past/into the chamber 210 and acting on the strike ring actuator 150. Such change may be an increase or decrease relative to a predetermined threshold (e.g., normal or current operating pressure and/or flow rate), and/or a series of increases and/or decreases, such as in implementations utilizing more than two angular offsets.

Figure 5:
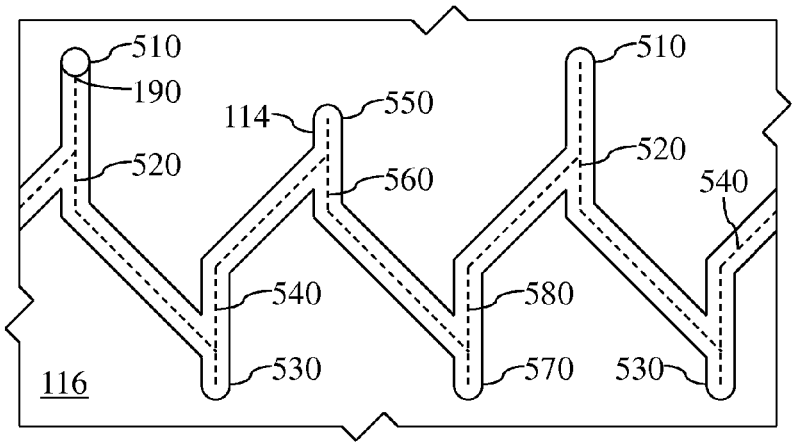
FIG. 5 is a schematic view of at least a portion of apparatus according to one or more aspects of the present disclosure.

Moreover, the axial position of the multi-angle strike ring 120 may be maintained after each repositioning by the engagement of one or more indexing members 190 within an indexing track 114 recessed within a substantially cylindrical surface 116 of the shaft 110. In FIG. 5, an "unrolled" view of a portion of the surface 116 of the shaft 110 depicts an example implementation of the indexing track 114 in which one of the indexing members 190 may travel during repositioning of the multi-angle strike ring 120. The indexing member 190 may be seated in a first static position 510 of the indexing track 114 when the strike ring actuator 150 has been operated to position the multi-angle strike ring 120 in the first position, as shown in FIG. 2. As the strike ring actuator 150 is subsequently actuated by a change in the pressure and/or flow rate of the drilling fluid in the central passage 112 of the shaft 110, the indexing member 190 may travel along a path 520 of the indexing track 114 towards an intermediate position 530, corresponding to the multi-angle strike ring 120 being in the position shown in FIG. 4.

The subsequent reversal of the change in the pressure and/or flow rate of the drilling fluid, and/or the biasing force of the biasing member 230, may then cause the indexing member 190 to travel along a path 540 of the indexing track 114 to a second static position 550, corresponding to the multi-angle strike ring 120 being positioned as shown in FIG. 3 (maintaining the second angular offset 202).

The strike ring actuator 150 may be subsequently actuated by another change in the pressure and/or flow rate of the drilling fluid in the central passage 112 of the shaft 110, causing the indexing member 190 to travel along a path 560 of the indexing track 114 towards another intermediate position 570. The subsequent reversal of the change in the pressure and/or flow rate of the drilling fluid, and/or the biasing force of the biasing member 230, may then cause the indexing member 190 to travel along a path 580 of the indexing track 114 to another static position 510, again corresponding to the multi-angle strike ring 120 being positioned to maintain the first angular offset 201, as shown in FIG. 2.

The process may then be repeated for each instance that, for example, the drilling trajectory is switched between curved and straight (or effectively straight). That is, in the example implementation described above and shown in FIGS. 2-5, there are two static positions for the multi-angle strike ring 120, which correspond to the two angular offsets 201 and 202 of the articulated member 130 and the drill bit 30 relative to the shaft 110. The multi-angle strike ring 120 may be alternatingly repositioned between the first and second static positions, which may correspond to the first and second static positions 510 and 550 of one or more indexing members 190, as shown in FIG. 5. However, the scope of the present disclosure also includes more complicated/sophisticated indexing tracks where, for example, the position of the multi-angle strike ring may be selectable by using half flow indexing, and/or the multi-angle strike ring 120 has more than two static positions, among other possible scenarios.

Figure 6:
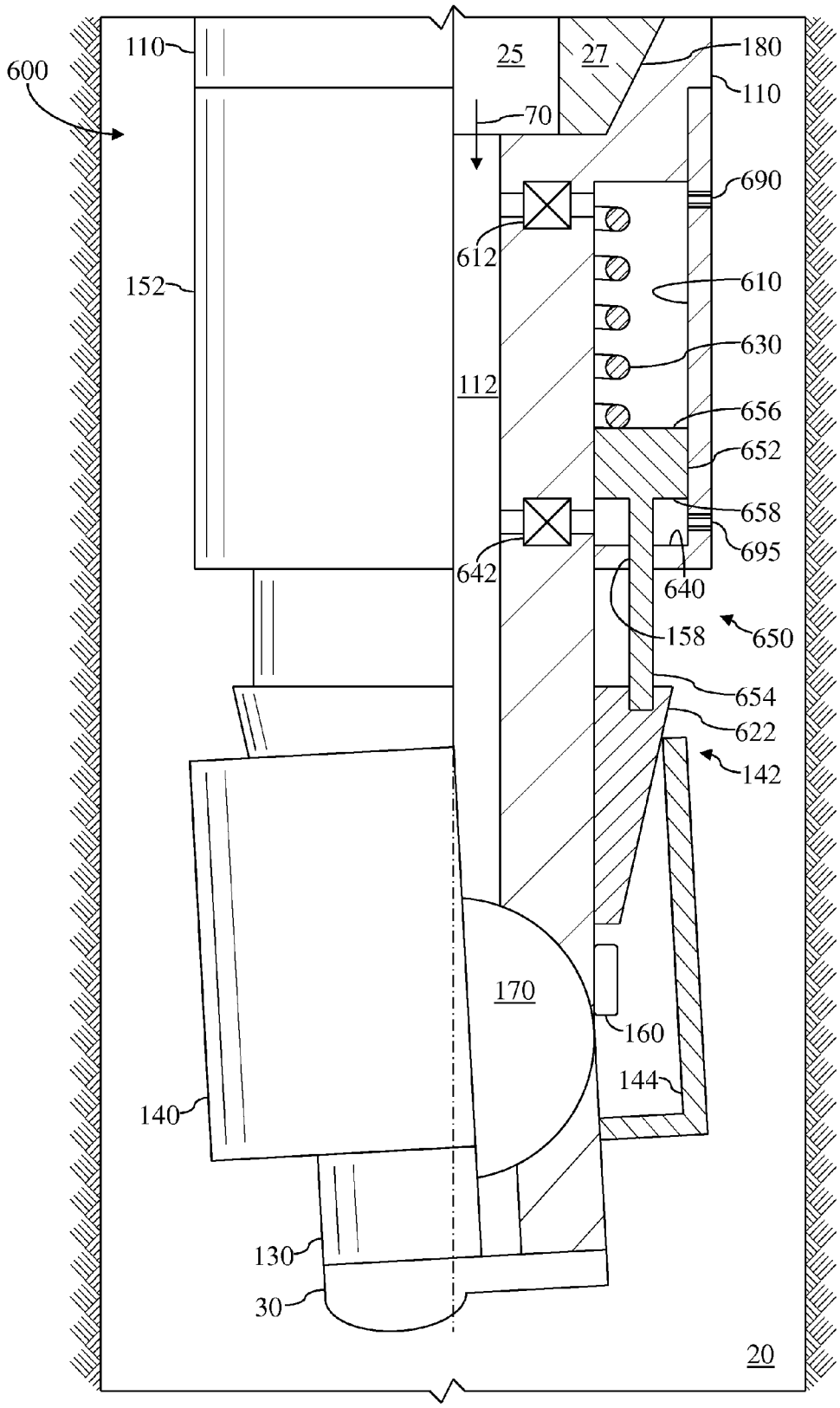
FIG. 6 is a schematic view of at least a portion of apparatus according to one or more aspects of the present disclosure.

FIG. 6 is a partial-sectional view of one such example, in which a strike ring actuator 650 comprising a piston head 652 and a piston rod 654 replaces the strike ring actuator 150 of the implementation depicted in FIGS. 2-5. The piston head 652 comprises opposing surfaces 656 and 658 that, in conjunction with corresponding surfaces of the shaft 110 and the retainer 152, define the boundaries of a first chamber 610 and a second chamber 640. Both chambers 610 and 640 are in alternating fluid communication with the drilling fluid in the internal passage 112 of the shaft 110 via operation of first and second valves 612 and 642, respectively.

For example, the first valve 612 may be or comprise a check valve and/or other type of valve. The first valve 612 may be normally open when the pressure of the drilling fluid in the internal passage 112 is below a predetermined pressure, but may close when the pressure of the drilling fluid exceeds the predetermined pressure. In contrast, while the second valve 642 may also be or comprise a check valve and/or other type of valve, it may be normally closed when the pressure of the drilling fluid is below the predetermined pressure, and may open when the pressure of the drilling fluid exceeds the predetermined pressure. The piston rod 654 is coupled to and/or otherwise extends from the downhole surface 658 of the piston head 652, through an opening 158 in the retainer 152, and to the multi-angle strike ring 620. Thus, the strike ring actuator 650 and, therefore, the multi-angle strike ring 620, may be repositioned relative to the shaft 110 by adjusting the drilling fluid pressure in the internal passage 112 of the shaft 110.

The downhole tool 600 shown in FIG. 6 may also comprise a spring or other biasing member 630, perhaps contained within the first chamber 610. The biasing member 630 may be utilized to urge the strike ring actuator 650 in a downhole direction, whether instead of or in conjunction with operation of one or both valves 612 and 642. In a similar implementation, the second chamber 640 may comprise a biasing member (not shown) that may be utilized to urge the strike ring actuator 650 in an uphole direction, whether instead of or in conjunction with one or both valves 612 and 642.

The retainer 152 and/or another component of the downhole tool 100 may comprise a choke 690 establishing fluid communication between the first chamber 610 and the borehole 20, and/or a choke 695 establishing fluid communication between the second chamber 640 and the borehole 20. The chokes 690 and 695 may each be or comprise a passive or active valve, orifice, and/or other means permitting restricted fluid communication from the corresponding chamber to the borehole 20, and/or otherwise controlling the pressure and/or flow rate within the corresponding chamber.

FIG. 6 also demonstrates that the two-position multi-angle strike ring 150 shown in FIGS. 2-4 may be replaced by the multi-angle strike ring 620. The multi-angle strike ring 620 may have a single, substantially conical contact surface 622 that is contacted by the steering member 140, instead of the multiple contact surfaces of the multi-angle strike ring 120 depicted in FIGS. 2-4. The single contact surface 622 of the multi-angle strike ring 620 may allow for continuous adjustment between minimum and maximum values of the angular offset between the axes of the shaft 110 and the articulated member 130 (and, hence, the drill bit 30).

Figure 7:
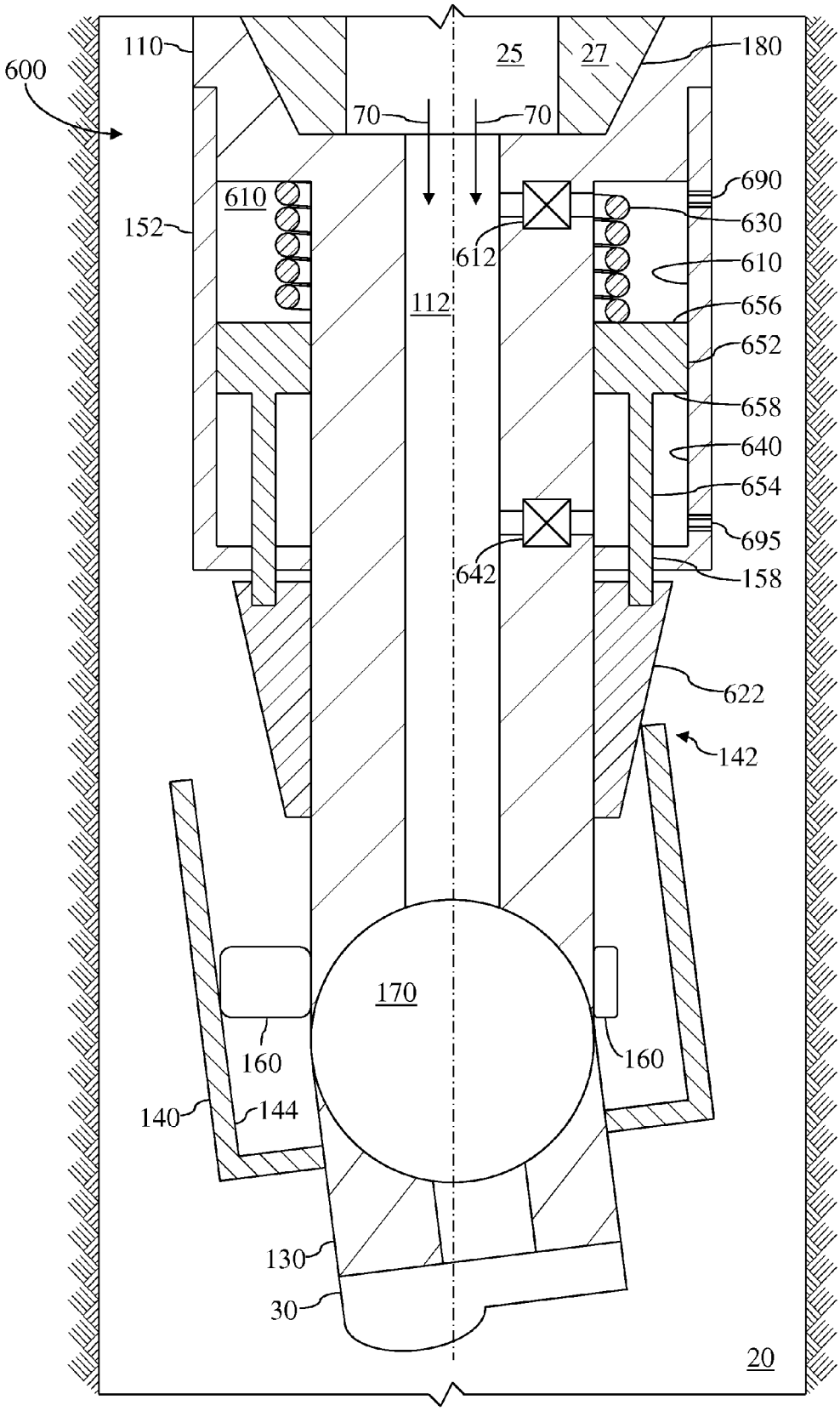
FIG. 7 is a schematic view of at least a portion of apparatus according to one or more aspects of the present disclosure.

For example, when the strike ring actuator 650 is fully extended, whether in response to the biasing force of the biasing member 630 and/or the pressure differential created across the piston head 652, the multi-angle strike ring 620 is positioned at its furthest downhole axial position, as shown in FIG. 6. However, as shown in the sectional view of the downhole tool 600 depicted FIG. 7, when the strike ring actuator 650 is axially repositioned in an uphole direction, whether in response to the biasing force of the biasing member 630 and/or the pressure differential created across the piston head 652, the multi-angle strike ring 620 is also axially repositioned in the uphole direction. Because the steering member actuators 160 continue to tilt the steering member 140 into contact with the multi-angle strike ring 620, the angular offset between the axes of the shaft 110 and the articulated member 130 (and, hence, the drill bit 30) increases, because the end 142 of the steering member 140 is now contacting a smaller-radius portion of the multi-angle strike ring 620.

Moreover, the full extension of the strike ring actuator 650 may be greater than as depicted in the example shown in FIG. 6. For example, the strike ring actuator 650 and the multi-angle strike ring 620 may collectively be configured such that the angular offset (e.g., angular offset 201 in FIG. 2 and/or angular offset 202 in FIGS. 3 and 4) may be maintained at substantially zero when the strike ring actuator 650 is fully extended. In one or more of such implementations, the largest outer diameter OD of the strike ring actuator 650 may be substantially equal to (or slightly larger than) the inner diameter ID of the inner periphery 144 of the multi-angle strike ring 620. As such, contact between the strike ring actuator 650 and the multi-angle strike ring 620 may be line contact along a circle extending around the strike ring actuator 650. In such configurations, the apparatus may be utilized to drill along a (substantially) literally straight trajectory, instead of the above-described effectively straight trajectory.

In the example implementation described above, drilling fluid ("mud") is utilized to cause movement of the strike ring actuator 650. However, an internal hydraulic fluid (e.g., gear oil) may be utilized instead of (or in addition to) the drilling fluid.

Figure 8:
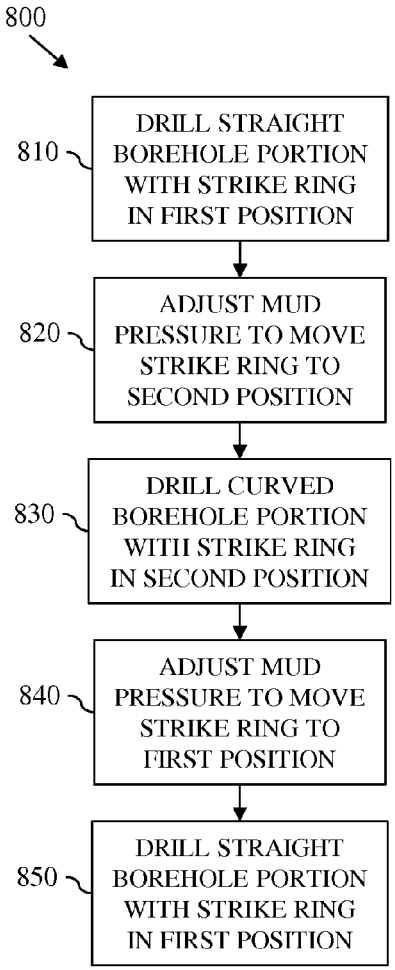
FIG. 8 is a flow-chart diagram of at least a portion of a method according to one or more aspects of the present disclosure.

FIG. 8 is a flow-chart diagram of at least a portion of a method (800) according to one or more aspects of the present disclosure. The method (800) may be executed utilizing rotary steerable drilling apparatus having one or more aspects in common with the apparatus shown in FIGS. 1-7 and/or otherwise within the scope of the present disclosure.

The method (800) includes drilling (810) a first portion of a borehole with a downhole tool by rotating a string of tubular members coupled to the downhole tool while operating an actuator of the downhole tool to maintain a first angular offset between axes of the downhole tool and a drill bit carried by the downhole tool. For example, in the context of the example implementations shown in FIGS. 1-7, operating the actuator to maintain the first angular offset may include maintaining azimuthally-dependent contact between a multi-angle strike ring and a steering member, wherein the multi-angle strike ring may be positioned in a first axial position relative to a shaft of the downhole tool, the steering member may be carried by an articulated member of the downhole tool, and the drill bit may extend from the articulated member.

The first borehole portion may be substantially straight and/or effectively straight, such as where the first borehole portion follows a substantially helical trajectory having a substantially straight axis. For example, drilling the first borehole portion (810) may include maintaining the azimuthally-dependent contact between the multi-angle strike ring and the steering member as contact that varies azimuthally relative to the borehole. The maintained contact may vary azimuthally relative to the borehole in proportion to rotation of the shaft within the borehole, as function of time, and/or otherwise.

After a predetermined time, or after the first borehole portion has been elongated to the intended length/depth, the first angular offset may be adjusted (820) to a second angular offset, such as by changing a pressure or flow rate of a drilling fluid flowing through the downhole tool from the string of tubular members. In the example implementations shown in FIGS. 1-7, such change in pressure and/or flow rate of the drilling fluid may axially translate the multi-angle strike ring along the shaft from the first axial position to a second axial position.

A second portion of the borehole may then be drilled (830) with the downhole tool by rotating the string of tubular members while operating the actuator to maintain the second angular offset. In the example implementations shown in FIGS. 1-7, operating the actuator to maintain the second angular offset of the articulated member relative to the shaft may include maintaining azimuthally-dependent contact between the steering member and the multi-angle strike ring positioned in the second axial position.

The second borehole portion may be substantially curved. For example, the azimuthally-dependent contact maintained between the multi-angle strike ring and the steering member may be substantially azimuthally-constant contact relative to the borehole.

The second angular offset may be substantially greater than the first angular offset. For example, the second angular offset may be twice the first angular offset, such as in implementations in which the second angular offset is about one degree and the first angular offset is about one-half of a degree. Of course, other values for the first and second angular offsets are also within the scope of the present disclosure.

After a predetermined time, or after the second borehole portion has been elongated to the intended length/depth, the second angular offset may be adjusted (840) back to the first angular offset, such as by again changing the pressure or flow rate of the drilling fluid flowing through the downhole tool from the string of tubular members. For example, such change in pressure and/or flow rate of the drilling fluid may axially translate the multi-angle strike ring along the shaft from the second axial position to the first axial position.

A third portion of the borehole may then be drilled (850) with the downhole tool by rotating the string of tubular members while operating the actuator to maintain the first angular offset. For example, operating the actuator to maintain the first angular offset of the articulated member relative to the shaft may include maintaining azimuthally-dependent contact between the steering member and the multi-angle strike ring positioned in the first axial position. As with the first borehole portion, the third borehole portion may be substantially straight and/or effectively straight, although the effective axes of the first and third borehole portions may not extend in the same direction.

The method (800) may include conveying a BHA comprising the downhole tool within the borehole while the first borehole portion is being drilled (810), while the second borehole portion is being drilled (830), and while the third borehole portion is being drilled (850), among other portions of the method (800). In the context of the example implementations shown in FIGS. 1-7, the BHA may be coupled to the string of tubulars, and may comprise the shaft, the multi-angle strike ring, the articulated member, the steering member, and the actuator of the downhole tool, and perhaps an interface for coupling with the string of tubular members. Drilling the first borehole portion (810), drilling the second borehole portion (830), and/or drilling the third borehole portion (850), among other portions of the method (800), may include rotating the BHA, such as by rotating the string of tubular members.

One or more aspects described above and/or shown in the figures may be presented in the context of a steerable tool platform having all-rotating, slowly-rotating, or non-rotating housings. However, a person having ordinary skill in the art will recognize that such aspects may be applicable or readily adaptable to each of such steerable tool platforms. Examples of such platforms may include those described within U.S. patent application Ser. No. 13/753,483, entitled "HIGH DOGLEG STEERABLE TOOL," filed Jan. 29, 2013, and listing Junichi Sugiura and Geoffrey Downton as inventors, the entire disclosure of which is hereby incorporated herein for all intents and purposes.

The implementations described above are also presented in the context of a strike ring that is circumferentially continuous. However, other implementations are also within the scope of the present disclosure. For example, the strike ring may be circumferentially discontinuous, having a plurality of circumferentially spaced portions. In implementations comprising a plurality of portions spaced proximate or adjacent one another, the resulting strike ring may be substantially continuous along the circumference, even though the strike ring is not fully continuous. These and similar implementations may also be within the scope of the present disclosure.

In view of all of the above, a person having ordinary skill in the art will readily recognize that the present disclosure introduces an apparatus comprising: a shaft; a multi-angle strike ring axially repositionable along the shaft; an articulated member coupled to the shaft; a steering member carried by the articulated member; and an actuator operable to maintain an angular offset of the articulated member relative to the shaft by maintaining azimuthally-dependent contact between the multi-angle strike ring and the steering member.

Such apparatus may further comprise a bottom-hole assembly (BHA) comprising the shaft, the multi-angle strike ring, the articulated member, the steering member, the actuator, and an interface for coupling with a string of tubular members collectively operable to convey the BHA within a borehole extending into a subterranean formation. The articulated member may comprise a drill bit rotatable via rotation of the shaft. The multi-angle strike ring may be axially repositionable along the shaft in response to fluid pressure changes within the string of tubular members. The multi-angle strike ring may be axially repositionable between a first position on the shaft and a second position on the shaft, the actuator and the multi-angle strike ring may be collectively operable to maintain a first angular offset of the articulated member relative to the shaft when the multi-angle strike ring is in the first position and to maintain a second angular offset of the articulated member relative to the shaft when the multi-angle strike ring is in the second position, wherein the second angular offset may be substantially different than the first angular offset. The first angular offset may be about one degree and the second angular offset may be about one half of a degree. The multi-angle strike ring may be axially repositionable substantially continuously between the first and second positions.

The apparatus may be positioned in a borehole being elongated along an effectively straight trajectory, and maintaining the azimuthally-dependent contact between the multi-angle strike ring and the steering member may comprise maintaining contact that varies azimuthally relative to the borehole. The maintained contact may vary azimuthally relative to the borehole in proportion to rotation of the shaft within the borehole.

The apparatus may be positioned in a borehole being elongated along a curved trajectory, and maintaining the azimuthally-dependent contact between the multi-angle strike ring and the steering member may comprise maintaining contact at a substantially constant azimuthal position relative to the borehole.

The present disclosure also introduces a method comprising: operating an actuator to maintain a first angular offset of an articulated member, relative to a shaft coupled to the articulated member, by maintaining azimuthally-dependent contact between: a multi-angle strike ring positioned in a first axial position relative to the shaft; and a steering member carried by the articulated member; axially translating the multi-angle strike ring along the shaft from the first axial position to a second axial position; and operating the actuator to maintain a second angular offset of the articulated member relative to the shaft by maintaining azimuthally-dependent contact between the steering member and the multi-angle strike ring positioned in the second axial position, wherein the second angular offset is substantially different than the first angular offset.

Such method may further comprise conveying a bottom-hole assembly (BHA) coupled to a string of tubular members within a borehole extending into a subterranean formation, wherein the BHA comprises the shaft, the multi-angle strike ring, the articulated member, the steering member, the actuator, and an interface for coupling with the string of tubular members. The method may further comprise rotating the BHA by rotating the string of tubular members. Rotating the BHA may include rotating a drill bit of the articulated member. The method may further comprise elongating the borehole along an effectively straight trajectory by maintaining the azimuthally-dependent contact between the multi-angle strike ring and the steering member as contact that varies azimuthally relative to the borehole. The maintained contact may vary azimuthally relative to the borehole in proportion to rotation of the shaft within the borehole. The method may further comprise elongating the borehole along a curved trajectory by maintaining the azimuthally-dependent contact between the multi-angle strike ring and the steering member as substantially azimuthally-constant contact relative to the borehole.

Axially translating the multi-angle strike ring along the shaft may comprise changing fluid pressure within the string of tubular members.

The first angular offset may be about one degree and the second angular offset may be about one half of a degree.

The multi-angle strike ring may be axially repositionable substantially continuously between the first and second axial positions.

The present disclosure also introduces a method comprising: drilling a first portion of a borehole with a downhole tool by rotating a string of tubular members coupled to the downhole tool while operating an actuator of the downhole tool to maintain a first angular offset between axes of the downhole tool and a drill bit carried by the downhole tool; adjusting the first angular offset to a second angular offset by changing a pressure or flow rate of a drilling fluid flowing through the downhole tool from the string of tubular members; and drilling a second portion of the borehole with the downhole tool by rotating the string of tubular members while operating the actuator to maintain the second angular offset.

Operating the actuator to maintain the first angular offset may comprise operating the actuator to maintain azimuthally-dependent contact between: a multi-angle strike ring positioned in a first axial position relative to a shaft of the downhole tool, wherein the multi-angle strike ring may be repositionable between the first axial position and a second axial position; and a steering member carried by an articulated member pivotally coupled to the shaft. The first borehole portion may be effectively substantially straight, and operating the actuator to maintain azimuthally-dependent contact between the steering member and the multi-angle strike ring in the first axial position may comprise maintaining contact that varies azimuthally relative to the borehole in proportion to rotation of the shaft within the borehole.

Adjusting the first angular offset to the second angular offset may comprise axially translating the multi-angle strike ring along the shaft from the first axial position to the second axial position. Operating the actuator to maintain the second angular offset may comprise operating the actuator to maintain azimuthally-dependent contact between the steering member and the multi-angle strike ring positioned in the second axial position. The second borehole portion may follow a substantially curved trajectory, and operating the actuator to maintain the azimuthally-dependent contact between the steering member and the multi-angle strike ring in the second axial position may comprise maintaining the contact at a substantially constant azimuthal position relative to the borehole.

The borehole may extend into a subterranean formation.

The first borehole portion may follow a curved trajectory and the second portion may follow an effectively straight trajectory. The effectively straight trajectory may comprise a substantially helical trajectory along a substantially straight line.

The first angular offset may be substantially greater than the second angular offset.

The first angular offset may be about one-half of a degree and the second angular offset may be about one degree.

The downhole tool may form at least a portion of a rotary steerable system.

Adjusting the first angular offset to the second angular offset may comprise changing fluid pressure within the string of tubular members.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a shaft;

a multi-angle strike ring axially repositionable along the shaft, the multi-angle strike ring comprising an inner diameter surface and an outer diameter surface;

an articulated member coupled to the shaft;

a steering member carried by the articulated member and circumferentially overlapping at least a portion of the outer diameter surface of the multi-angle strike ring; and an actuator operation to maintain an angular offset of the articulated member relative to the shaft by maintaining azimuthally-dependent contact between the multi-angle strike ring and the steering member.

2. The apparatus of claim 1 further comprising a bottom-hole assembly (BHA) including the shaft, the multi-angle strike ring, the articulated member, the steering member, the actuator, and an interface for coupling with a string of tubular members collectively operable to convey the BHA within a borehole extending into a subterranean formation, wherein the articulated member includes a drill bit rotatable via rotation of the shaft.

3. The apparatus of claim 2 wherein the multi-angle strike ring is axially repositionable along the shaft in response to fluid pressure changes within the string of tubular members.

4. The apparatus of claim 1 wherein the multi-angle strike ring is axially repositionable between a first position on the shaft and a second position on the shaft, wherein the actuator and the multi-angle strike ring are collectively operable to maintain a first angular offset of the articulated member relative to the shaft when the multi-angle strike ring is in the first position, wherein the actuator and the multi-angle strike ring are collectively operable to maintain a second angular offset of the articulated member relative to the shaft when the multi-angle strike ring is in the second position, and wherein the second angular offset is substantially different than the first angular offset.

5. The apparatus of claim 4 wherein the multi-angle strike ring is axially repositionable continuously between the first and second positions.

6. The apparatus of claim 4, wherein the first angular offset is about twice the second angular offset.

7. The apparatus of claim 1, wherein the actuator includes a piston that acts on an inner periphery of the steering member.

8. The apparatus of claim 1, wherein the multi-angle strike ring includes a conical section.

9. The apparatus of claim 1, wherein the multi-angle strike ring is circumferentially discontinuous.

10. A method, comprising:

operating an actuator to maintain a first angular offset of an articulated member, relative to a shaft coupled to the articulated member, by maintaining azimuthally-dependent contact between:

a multi-angle strike ring positioned in a first axial position relative to the shaft, the multi-angle strike ring comprising an inner diameter surface and an outer diameter surface; and a steering member carried by the articulated member and circumferentially overlapping at least a portion of the outer diameter surface of the multi-angle strike ring;

axially translating the multi-angle strike ring along the shaft from the first axial position to a second axial position; and operating the actuator to maintain a second angular offset of the articulated member relative to the shaft by maintaining azimuthally-dependent contact between the steering member and the multi-angle strike ring positioned in the second axial position, wherein the second angular offset is substantially different than the first angular offset.

11. The method of claim 10 further comprising:

conveying a bottom-hole assembly (BHA) coupled to a string of tubular members within a borehole extending into a subterranean formation, wherein the BHA includes the shaft, the multi-angle strike ring, the articulated member, the steering member, the actuator, and an interface for coupling with the string of tubular members; and rotating the BHA by rotating the string of tubular members, wherein rotating the BHA includes rotating a drill bit coupled to the articulated member.

12. The method of claim 11 further comprising elongating the borehole along an effectively straight trajectory by maintaining the azimuthally-dependent contact between the multi-angle strike ring and the steering member as contact that varies azimuthally relative to the borehole, wherein the effectively straight trajectory is a helical trajectory around a substantially straight axis.

13. The method of claim 11 further comprising elongating the borehole along a curved trajectory by maintaining the azimuthally-dependent contact between the multi-angle strike ring and the steering member as substantially azimuthally-constant contact relative to the borehole.

14. The method of claim 11 wherein axially translating the multi-angle strike ring along the shaft includes changing fluid pressure within the string of tubular members.

15. A method, comprising:

drilling a first portion of a borehole with a downhole tool by rotating a string of tubular members coupled to the downhole tool while operating an actuator of the downhole tool to maintain a first angular offset between axes of the downhole tool and a drill bit carried by the downhole tool;

adjusting the first angular offset to a second angular offset by changing a pressure of a drilling fluid flowing through the downhole tool from the string of tubular members or flow rate of a drilling fluid flowing through the downhole tool from the string of tubular members to actuate a multi-angle strike ring, wherein the multi-angle strike ring is configured to be axially moveable relative to a shaft of the downhole tool and wherein at least a portion of an exterior of the multi-angle strike ring is circumferentially overlapped by a steering member; and drilling a second portion of the borehole with the downhole tool by rotating the string of tubular members while operating the actuator to maintain the second angular offset.

16. The method of claim 15 wherein operating the actuator includes operating the actuator to maintain azimuthally-dependent contact between:

the multi-angle strike ring positioned in an axial position relative to the shaft of the downhole tool, wherein the multi-angle strike ring is repositionable between a first axial position and a second axial position; and the steering member carried by an articulated member pivotally coupled to the shaft.

17. The method of claim 16 wherein the first borehole portion is effectively substantially straight, and wherein operating the actuator to maintain azimuthally-dependent contact between the steering member and the multi-angle strike ring in the first axial position includes maintaining contact that varies azimuthally relative to the borehole in proportion to rotation of the shaft within the borehole.

18. The method of claim 16 wherein adjusting the first angular offset to the second angular offset includes axially translating the multi-angle strike ring along the shaft from the first axial position to the second axial position.

19. The method of claim 18 wherein the second borehole portion follows a substantially curved trajectory, and wherein operating the actuator to maintain azimuthally-dependent contact between the steering member and the multi-angle strike ring in the second axial position includes maintaining azimuthally-dependent contact at a substantially constant azimuthal position relative to the borehole.

20. The method of claim 15 wherein the first borehole portion follows a curved trajectory and the second portion follows an effectively straight trajectory, and wherein the effectively straight trajectory includes a substantially helical trajectory around a substantially straight axis.

* * * * *